US005980403A

United States Patent [19]

Simidian, II

[11] Patent Number: 5,980,403

[45] Date of Patent: Nov. 9, 1999

[54] DEVICES AND METHOD FOR MAINTAINING STRING TENSION

[76] Inventor: Vahan Simidian, II, 2215 Heather La., Newport Beach, Calif. 92660

[21] Appl. No.: 09/074,897

[22] Filed: May 8, 1998

[51] Int. Cl.[6] ..... A63B 51/00

[52] U.S. Cl. ..... 473/553; 473/548

[58] Field of Search ..... 473/539, 543, 473/548, 553

[56] References Cited

U.S. PATENT DOCUMENTS

| | | | |
|---|---|---|---|
| 2,542,661 | 2/1951 | Godfrey | 473/539 |
| 3,567,225 | 3/1971 | Hollis | 473/539 X |
| 3,884,467 | 5/1975 | Sommer | 473/539 |
| 5,257,781 | 11/1993 | Sines et al. | 473/539 |
| 5,290,031 | 3/1994 | Natsume | 473/539 X |
| 5,570,883 | 11/1996 | Csabai | 473/543 |
| 5,762,570 | 6/1998 | Shaw | 473/522 |

FOREIGN PATENT DOCUMENTS

| | | | |
|---|---|---|---|
| 2611970 | 9/1977 | Germany | 473/FOR 178 |

*Primary Examiner*—Raleigh W. Chiu
*Attorney, Agent, or Firm*—Thomas P. Mahoney

[57] ABSTRACT

Racket string tension-maintaining means includes a plurality of surface areas between the string receiving openings in the frame of said racket, the surfaces incorporating frictional means engagable with the bights of said strings to prevent the movement thereof relative to said frame.

14 Claims, 1 Drawing Sheet

DEVICES AND METHOD FOR MAINTAINING STRING TENSION

This application claims the benefit of U.S. Provisional Application No. 60/051,779, filed Jul. 7, 1997.

This invention relates to devices and a method for locking the strings of a racket, such as a tennis racket, to prevent movement thereof which causes loss of tension on the strings of the racket.

The strings of the rackets are oriented axially and transversely of one another and, thus, are interwoven to provide a striking surface for the racket. The string tension established on the axial and transverse strings determines the creation of the "sweet spot" which is the location on the strings customarily utilized by the player when striking a ball or other object.

In conventional stringing of rackets, the strings are tensioned to locate the sweet spot and to provide the desired deflection of the strings when a ball is struck. In addition, the size of the sweet spot may be determined by the tensional force exerted upon the strings.

However, during continued play with a conventional racket, the original tension on the strings is gradually lost because the strings tend to move from their original locations of adjustment achieved during the stringing process. Consequent diminishment of the sweet spot occurs which results in a loss of striking effect by the player. Moreover, in conventionally strung rackets, the sweet spot is altered each time the ball is struck.

The devices and method for string locking are intended to eliminate the vibration which is the resultant of string movement, thus materially reducing the shock load imposed upon the arm and elbow of the person wielding the racket. Additionally, the string locking structure eliminates the loss of tension and materially increases the sweet spot on the strings of the racket significantly augmenting in the speed of ball return, ball trajectory, and ball control.

BACKGROUND OF THE INVENTION

It is well known to those skilled in the art that rackets of various types, such as tennis rackets, rapidly lose the string tension which is created during the stringing of the racket. Such loss of tension occurs during a tennis match and results in a series of deleterious conditions, including excessive vibration, string wear, and loss of ball control because of the deterioration of the striking surface resulting from the loosening of the strings.

In addition, as tension is lost, the consequent vibration causes considerable physical damage to the wielder of the racket, resulting in such negative phenomena as the tennis elbow and rotator cuff syndromes.

OBJECTS AND ADVANTAGES OF THE INVENTION

It is, therefore, a primary object of my invention to provide devices and a method for locking the strings of a racket to the frame of the racket, thus preventing loss of tension and equilibrium of the strings. The equilibrium referred to is that which is established during stringing by the tensioning of the axial and transverse strings of the racket. The interaction between the axial and transverse strings, when tensioned, establishes the sweet spot.

Another object of my invention is the provision of frictional surfaces on the frame of the racket between the string holes, said frictional surfaces being engaged by the bight portion of the strings overlying the frame of the racket between the string holes.

An additional object of my invention is the provision of frictional tabs underlying the bights of the strings between the string holes, said tabs having dual abrasive surfaces, that is, abrasive means on the upper and lower surfaces thereof whereby the lower surfaces of the tabs engage the underlying frame of the racket and the upper surfaces of the tab engage the undersides of the bights of the strings themselves.

Another object of my invention is the provision of locking tape, said locking tape being provided in a roll and having abrasive surfaces on the opposite sides thereof.

Another object of my invention is the provision of a locking tape of the aforesaid character which is scored to provide a plurality of tabs which may be successively stripped from the tape during stringing of the racket.

As an alternative expedient to providing such tapes, the racket may be coated with a liquid having abrasive particles suspended therein whereby an abrasive surface will be presented to the strings of the racket in the same manner as the abrasive tabs.

A further object of my invention is the provision of a method of locking the strings of a racket to the racket when a desired tension on the strings is achieved.

An additional object of my invention is the provision of a string-locking means which includes an abrasive surface on the frame of the racket engagable by the racket strings.

A further object of the invention is the provision of a device consisting of a tape which is abrasively coated on both sides and which is of a width that will fit between the string holes of a racket to be engaged on the racket surface and by the portion of the strings extending between the string holes.

Other objects and advantages of the invention will be apparent from the following specification and the accompanying drawings.

PREFERRED EMBODIMENTS OF THE INVENTION

Figure 1:
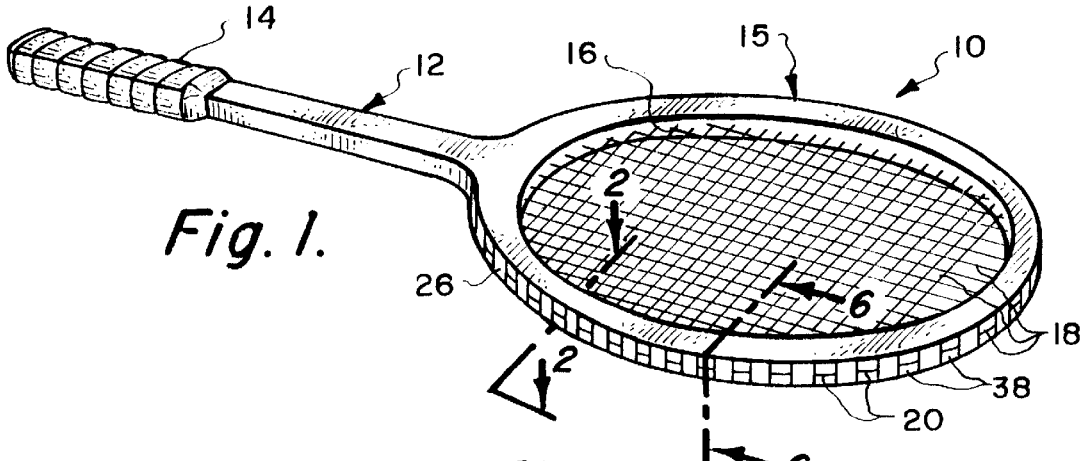
FIG. 1 is a view showing a tennis racket incorporating the string lock of the invention.
Figure 2:
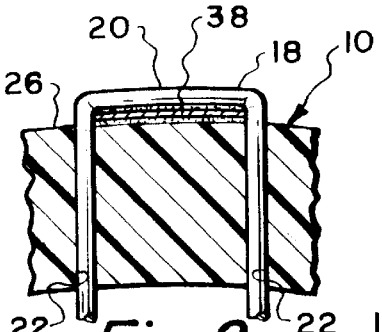
FIG. 2 is a cross-sectional view taken on the line 2—2 of FIG. 1.

Referring to the drawing and, particularly, to FIGS. 1 and 2 thereof, I show a tennis racket 10 of conventional construction including a shaft 12, a hand grip 14, and an ovoid section or head 15 which is provided with an opening 16 which is strung with strings 18 to provide a ball-striking surface. Of course, the teachings of the invention can be applied with equal cogency to various other types of rackets, such as squash, racquetball, badminton, and the like. As is well known to those skilled in the art, the strings 18 are fabricated from synthetic materials such as nylon or the like and are commonly, during the stringing process, subjected to tension sufficient to provide a ball-striking surface or sweet spot. The axial strings extend along the length of the head 15 and are intersected by the transverse strings.

Characteristically, most players, including amateurs and, particularly, professionals have rigid requirements regarding the stringing of their rackets and, frequently, during a tennis match, a professional will change his racket because he has become dissatisfied with what he may perceive to be a loss of tension due to deterioration in the sweet spot in the strings.

In order to avoid a loss of tension in the strings 18 of a racket, I provide a plurality of locking devices, as best shown in FIGS. 2, 3, 4, and 7 of the drawings whereby movement of the bight portions 20 of the strings 18 intermediate the string holes 22 in the racket frame 26 is eliminated.

Figure 3:
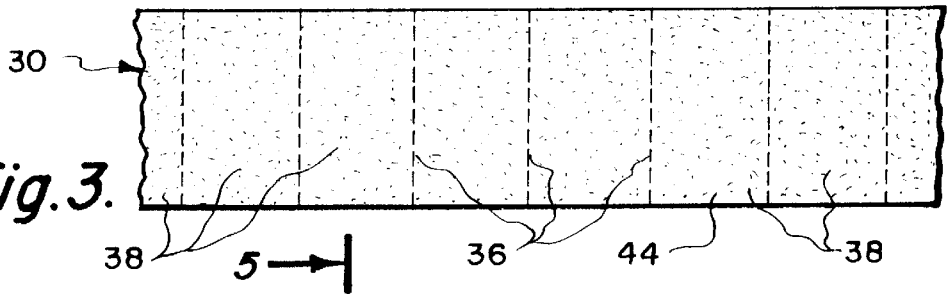
FIG. 3 is one of a variety of devices which can be utilized to practice the method of the invention.
Figure 5:
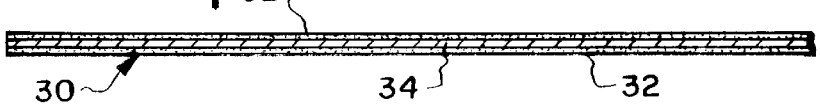
FIG. 5 is a cross-sectional view taken on the broken line 5—5 of FIG. 4.

A typical locking device of my invention is shown in FIG. 3 as consisting of an elongated tape 30, said tape being provided in a roll which may be located in a dispenser. The tape 30 is coated, as best shown in FIG. 5 of the drawings with abrasive material indicated at 32. The abrasive material may be drawn from any one of a wide class of abrasive materials, such as silicon, carborondum, or the like, and the body 34 of the tape can formed from any one of a plurality of synthetic plastic materials, such as vinyl, mylar, or the like.

Although I have shown the use of abrasive materials to prevent movement of the bights 20 of the strings 18, alternative materials such as various types of adhesives or the like may be utilized in substitution for the abrasive materials. Any material which will prevent movement of the bights 20 of the strings 18 can, obviously, be utilized to make the devices and practice the method of the invention.

The body 34 of the tape is provided with a plurality of equally spaced scorelines 36, which define tabs 38 and, as best shown in FIG. 1 of the drawings, are susceptible of being inserted under the bights 20 of the strings 18 extending between the string holes 22 of the racket frame 26.

Figure 6:
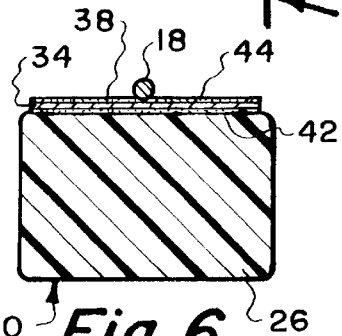
FIG. 6 is a transverse sectional view taken on the broken line 6—6 of FIG. 1.

A tab 38 is shown in FIGS. 2 and 6 as being retained by the tensioned strings 18 forcing the abrasive undersurface 42 of the tab 38 into engagement with the surface of the racket 10. The upper abrasive surface 44 of the tab 38 is engaged by the bight 20 of string 18, thus preventing relative movement between the bight 20 of the string 18 and frame 26 of the racket 10.

The installation of the tabs 38 successively under the bights 20 of the strings 18 is accomplished during the stringing process by inserting the free end of the tape under the bight 20 of a string 18 as it is subjected to tension. When the proper tension is achieved and the tab 38 is locked against the frame of the racket, the tab will be torn from the tape 30 by the releasing action of the associated scoreline 36.

After the strings 18 have been tensioned to the requirements of the player with the tabs 38 inserted under the bights 20 of the strings, they are locked against movement relative to the frame 26 of the racket. During play, the ball is struck and the normal tendency of the strings, in conventional racket/string combinations, is to respond by movement induced by the striking of the ball.

In the present invention, the abrasive surfaces 42 and 44 of the tabs 38 prevent such movement and, thus, the strings remain at the optimum tension established during the stringing process.

In addition, the vibratory effect induced by movement of the strings is eliminated. This is a significant factor in the performance of a player, since the load imposed upon the elbow and shoulder of a player by the vibration of the strings is frequently the cause of such syndromes as tennis elbow and rotator cup injuries. Moreover, the maintenance of tension enlarges the sweet spot on the strings resulting in more effective ball return so far as speed, trajectory, and other factors are concerned.

In addition, the movement of the strings in ordinary racket/string combinations causes wear upon the strings 18 at the points where they are threaded through the string holes 22 in the frame 26 of the racket. The prevention of movement of the bights 20 of the strings 18 eliminates the necessity for replacing the strings 18 as frequently as has been the case in the past.

Figure 4:
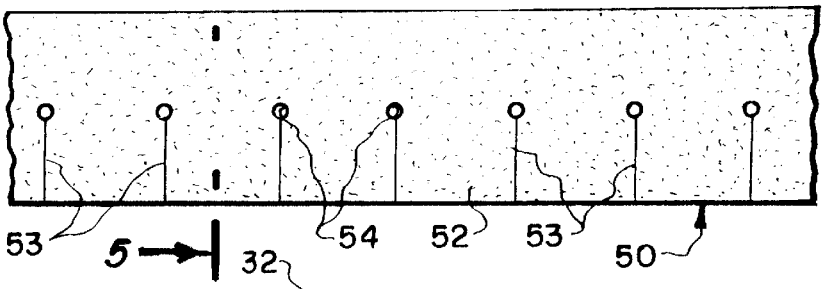
FIG. 4 is an alternative form of locking device.

Another braking device 50 is shown in FIG. 4 of the drawings as consisting of an elongated tape 52 fabricated in the same manner as the tape of FIG. 3 with the additional provision of slits 53 which communicate with string holes 54. Therefore, instead of providing separate tabs 38, the elongated tape 50 can be provided in a length equivalent to the ovoid portion of the racket 10. The slits 53 permit the location of the strings 18 in the holes 54 in the tape 52 and the string holes 54 of the device 50 and provide the same benefits as those characteristic of the previously discussed tab device of FIG. 3.

Bumper guards are frequently utilized on the perimeter of the ovoid portion 15 of the frame 26 of a tennis racket. These guards are manufactured out of various resilient materials by injection molding and have openings coincident with the string holes 22 in the frame 26 of the racket. Where such guards are used, the abrasive material can be provided in the material from which the guards are molded to impart the string braking action of the invention.

Figure 7:
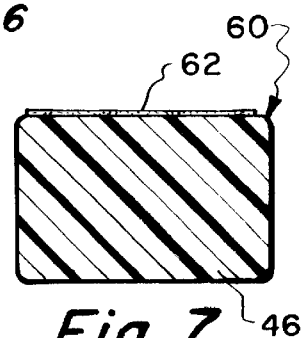
FIG. 7 is a transverse sectional view showing another embodiment of the teachings of the invention.

In addition to providing separate devices for utilization under the bights 20 of the strings 18, the frame 26 of the racket 10 can be provided with an abrasive surface 62, as best shown in FIG. 7 of the drawings, by suspending the abrasive grit in a fluid such as varnish or the like. Therefore, the outer surface of the frame 26 can be coated with the abrasive material 62 and the same restriction in braking of the bights 20 of the strings 18 can be achieved.

Although I have shown and described alternative forms of the devices of the invention, the practice of the method of the invention includes the presentation of an abrasive surface to the strings of the racket at the bights 20 thereof intermediate the string holes 22. Where devices, such as those of FIGS. 3 and 4 are utilized, abrasive surfaces are provided on both sides of the devices. On the other hand, where an abrasive coating is applied to the frame 26 of the racket 10, as shown in FIG. 7 of the drawings, only one abrasive surface need be provided.

Moreover, while I have shown a variety of devices which will assist in achieving the beneficial results alluded to hereinabove in discussing the action of the abrasive surfaces in braking the strings, it will apparent to those skilled in the art that there is a wide spectrum of alternative means of providing a braking action on the strings of the racket and it is not intended that the teachings of the invention be limited to the specific braking devices shown in the drawings and described herein.

I claim:

1. String tension-maintaining means for the strings of a racket which incorporates a frame having a plurality of spaced openings for the reception of said strings, the spaces between said openings receiving the bights of said strings including motion-preventing means insertable under said bights and over said spaces.

2. The tension-maintaining means of claim 1 in which said motion-preventing means includes a series of tabs locatable under said bights.

3. The tension-maintaining means of claim 1 in which said motion-preventing means is to be incorporated in the surfaces of said racket underlying said bights.

4. The tension-maintaining means of claim 1 in which said tension-maintaining means is to be incorporated in the material from which said racket is fabricated.

5. The motion-preventing means of claim 1 in which said motion preventing means is to be incorporated in a guard provided on the exterior of said frame.

6. A string tension-maintaining device for a racket including an elongated strip having a motion-preventing upper surface thereupon engagable with the bights of the strings of said racket whereby, when said strings strike an object such as a ball or shuttle, the load generated by the impact will not cause the movement of said strings due to the engagement of the bights of said strings with said motion-preventing surface.

7. The device of claim 6 in which said strip is provided with a plurality of scorelines defining frictional surfaces so that individual tabs may be inserted under said bights and torn from said strip at said scorelines.

8. A tennis racket having a frame with a head incorporating a string-receiving opening, said frame having a plurality of spaced openings communicating with said frame opening for the reception of racket strings, the outer surface of said frame between said openings incorporating motion-preventing frictional material for receiving the bights of the strings when said strings are subjected to tension to prevent the movement of said bights and the consequential movement of said strings when said strings are impacted by a ball or the like during the striking of said ball by said racket.

9. The racket of claim 8 in which said frictional surface is provided by frictional substances incorporated in the material from which said racket is fabricated.

10. The racket of claim 8 in which said frictional surfaces are provided by a coating on the surface of said frame.

11. Tabs having abrasive material on the upper and lower surfaces thereof for insertion under the bights of racket strings between said bights and the frame of said racket to prevent movement of said bights after said strings have been tensioned against said tabs.

12. In a method of maintaining string tension on a racket which incorporates a frame having a plurality of spaced openings for the reception of said strings, the bights of said strings overlying said frame between said openings, including the step of:

inserting motion-preventing means between the string openings in said frame to prevent movement of the bights of the strings when said strings strike a ball or similar object.

13. The method of claim 12 which includes the step of providing said motion-preventing means by inserting abrasive tabs between the surface of said frame and the bights of said strings between said openings.

14. The method of claim 12 in which an abrasive strip is inserted under the bights of said strings.

* * * * *